US006634191B1

(12) United States Patent
Guler et al.

(10) Patent No.: US 6,634,191 B1
(45) Date of Patent: Oct. 21, 2003

(54) WASHING MACHINE

(75) Inventors: Emin Cagatay Guler, Istanbul (TR); Stefanie Murach, Istanbul (TR)

(73) Assignee: Arcelik A.S., Istanbul (TR)

( * ) Notice: Subject to any disclaimer, the term of this patent is extended or adjusted under 35 U.S.C. 154(b) by 0 days.

(21) Appl. No.: 09/914,273

(22) PCT Filed: Aug. 10, 1998

(86) PCT No.: PCT/TR98/00015

§ 371 (c)(1),
(2), (4) Date: Aug. 24, 2001

(87) PCT Pub. No.: WO00/09792

PCT Pub. Date: Feb. 24, 2000

(51) Int. Cl.[7] ..... D06F 33/02
(52) U.S. Cl. ..... 68/12.04; 68/12.19
(58) Field of Search ..... 68/12.02, 12.04, 68/12.05, 12.19, 207

(56) References Cited

U.S. PATENT DOCUMENTS 4,235,085 A * 11/1980 Torita
4,503,575 A * 3/1985 Knoop et al.
5,144,819 A * 9/1992 Hiyama et al.
5,715,555 A * 2/1998 Reber et al.
5,987,679 A * 11/1999 Won
6,158,072 A * 12/2000 Baek et al.

FOREIGN PATENT DOCUMENTS

| | | | |
|---|---|---|---|
| DE | 40 38 802 A1 | | 6/1992 |
| EP | 0 476 423 A1 | | 3/1992 |
| JP | 53-142053 | * | 12/1978 |
| JP | 54-147661 | * | 11/1979 |
| JP | 2-164393 | * | 6/1990 |

OTHER PUBLICATIONS

European Patent Application 294,014 Dec. 1988.*

* cited by examiner

*Primary Examiner*—Frankie L. Stinson
(74) *Attorney, Agent, or Firm*—Nixon & Vanderhye

(57) ABSTRACT

A washing machine (2) comprising a drum (4) for receiving a load of laundry to be washed, a detergent chamber (6) for receiving detergent to be used in the washing of the laundry, a water intake valve (8) for allowing a water intake into the washing machine (2), a pressure sensor (16) for measuring pressure signals, and electronic control means (12) for providing washing programs for the washing machine (2), and for detecting the quantity and type of the laundry in the load, characterized in that the electronic control means (12) which acts firstly to detect the quantity of the laundry in the load through counting the number of openings of the water intake valve (8) and which acts secondly to determine the type of laundry in the load by utilizing the timing of the openings and closings of the water intake valve and the water release properties of the laundry in the load.

12 Claims, 5 Drawing Sheets

WASHING MACHINE

This invention relates to a washing machine and, more especially, this invention relates to a washing machine having electronic control means for detecting the quantity and type of laundry in a load of laundry to be washed.

Washing machines are known comprising electronic control means for detecting the quantity and type of laundry in a load to be washed. The ability to detect the quantity and type of the laundry in a load enables the electronic control means to adjust to the detected quantity and type of the laundry in a load, and thereby always provide optimum washing conditions irrespective of the quantity and type of the laundry in the load.

The electronic control means in the known washing machines are all relatively similar because only a relatively small number of properties of the laundry are suitable for detection. Typical of such properties are the water absorbent properties of the laundry and the water release properties of the laundry. Washing machines having generally similar electronic control means are disclosed in DE 4122307, EP 787848 and EP 717139.

In DE 4122307, the electronic control means relies on time intervals following the first two intakes of water, but only considers the differences between the time intervals.

In EP 787848, the electronic control means requires major changes to the initial phase of the washing program, as well as to the duration of the first two water intakes and to the duration of the following agitation periods. The decision parameter is the value of a ratio that is obtained by dividing the time of a third non-preset water intake by the time of a first water intake. An agitation phase follows with a preset duration. After completion of the agitation phase, the time until a lowered water level is restored is measured. The duration of the agitation phase and the water intake are strictly controlled or predetermined.

In EP 717139, the washing machine is fed with information about the quantity of the laundry in the load. The aim is merely to detect the type of the laundry in the load. Also, the washing machine operates with a water circulation installation giving jets of water. The electronic control means looks at the percentage of water being soaked up by the load, after filling a definite amount of water into the drum and subsequently agitating the drum for a certain number of revolutions. Thus the washing machine disclosed in EP 717139 utilises a relatively direct way of detecting the type of laundry in a load.

It is an aim of the present invention to provide a washing machine which enables as compared with the above known washing machines, a more accurate estimate of the quantity and type of the laundry in the load, a shorter washing program duration, and less usage of water.

Accordingly, the present invention provides a washing machine comprising a drum for receiving a load of laundry to be washed, a detergent chamber for receiving detergent to be used in the washing of the laundry, a water intake valve for allowing a water intake into the washing machine, electronic control means, for detecting the quantity and type of the laundry in the load and for providing washing programs for the washing machine, and a pressure sensor which acts to measure pressure signals used for determining the quantity and type of the laundry in the load.

The washing machine of the present invention is such that the electronic control means is able to take into account characteristics of the laundry that depend upon the type and quality of fibre of the laundry, as well as the structure of the fabric of the laundry. In order to achieve this identification, the initial phase of water intake and agitation, until an introduced load is completely wet, is altered in such a way that it supplies sufficient information for the identification of the laundry. The washing machine of the present invention may operate such that the interval between water pressure levels for opening and closing of the water intake valve may be decreased by setting the required pressure for opening the water intake valve to a higher value. This achieves a smaller amount of water per intake, which enables more precise control in the amount of water needed for any one particular load. The washing machine of the present invention may give a very high resolution of detection of the quantity of the laundry in the load in the washing machine.

The washing machine may be one in which the control of the water intake is effected by the pressure sensor measuring the pressure, and in which the measuring of the pressure signals is in dependence upon water absorption and water release properties of the laundry in the load. In this case, the washing machine may be one in which the electronic control means operates to determine the quantity of the laundry in the load by counting the number of openings of the water intake valve and a stabilised pressure value in the pressure signal measured by the pressure sensor, and in which the electronic control means operates to determine the type of the laundry in the load by utilising (i) the time interval between a second opening of the water intake valve and a first closing of the water intake valve, and the time interval between a third opening of the water intake valve and a second closing of the water intake valve, (ii) the time values of the first closing of the water intake valve, the second closing of the water intake valve, the second opening of the water intake valve, and the third opening of the water intake valve, and (iii) the water release properties of the laundry in the load as indicated by pressure changes measured by the pressure sensor.

The washing machine may be one in which the electronic control means determines the quantity of the laundry in the load by counting the number of openings of the water intake valve at a plurality of different first decision levels.

Preferably, there are six of the different first decision levels.

Preferably, the six different first decision levels are an almost empty level, a very low volume level, a low volume level, a medium volume level, a high volume level, and a very high volume level.

The washing machine may be one in which the electronic control means determines the type of laundry in the load by utilising (i) the time interval between a second opening of the water intake valve and a first closing of the water intake valve, and the time interval between a third opening of the water intake valve and a second closing of the water intake valve, (ii) the time values of the first closing of the water intake valve, the second closing of the water intake valve, the second opening of the water intake valve, and the third opening of the water intake valve, and (iii) the water release properties of the laundry in the load as indicated by pressure changes measured by the pressure sensor, at a plurality of different second decision levels.

Preferably, there are three of the different second decision levels.

Preferably, the three different second decision levels are for the laundry being such that it has high water absorption and respective water release properties, for the laundry being such that it has medium water absorption and respective water release properties, and for the laundry being such that it has low water absorption and respective water release properties. Examples of laundry having high water absorption and respective water release properties are cotton terry towels and knitted wool articles. Examples of laundry having medium water absorption and respective water release properties are standard cotton articles. Examples of laundry having low water absorption and respective water release properties are synthetic fabrics and jeans.

In a first embodiment of the invention, the washing machine is one in which the electronic control means controls the water intake by the following steps:

(i) opening the water intake valve until a predetermined upper threshold pressure value which is measured by the pressure sensor is reached;

(ii) closing the water intake valve, commencing agitation, and allowing the laundry to absorb water until a predetermined lower threshold pressure value is reached;

(iii) repeating steps (i) and (ii) until the laundry is completely wet, and the measured pressure stabilises at a level; and (iv) providing a period during which there is no agitation of the laundry and no intake of the water, whereby the laundry releases water and causes a pressure increase, and the pressure sensor measures the pressure increase to obtain information about the type of the laundry in the load.

In a second embodiment of the invention, the washing machine is one in which the electronic control means controls the water intake by the following steps:

(i) opening the water intake valve until a predetermined upper threshold pressure value which is measured by the pressure sensor is reached;

(ii) closing the water intake valve, commencing agitation, and allowing the laundry to absorb water until a predetermined lower threshold pressure value is reached;

(iii) repeating steps (i) and (ii) for a predetermined duration unless the lower threshold pressure value is reached;

(iv) closing the water intake valve, commencing agitation, and maintaining the agitation for a predetermined period even if the pressure level drops below the predetermined minimum lower threshold value;

(v) at the end of the predetermined period in step (iv) opening the water intake valve if the pressure level in step (iv) has dropped below the predetermined minimum lower threshold value;

(vi) repeating steps (iv) and (v) until the laundry is completely soaked as indicated by a stabilisation of the pressure;

(vii) checking after a predetermined time that the pressure is still stable and if the pressure has dropped repeating step (v) one more time; and (viii) providing a period during which there is no agitation and no intake of the water, whereby the laundry releases water and causes a pressure increase, and the pressure sensor measures the pressure increase to obtain information about the type of the laundry in the load.

In the first and the second embodiments of the invention, the washing machine may be such that the electronic control means determines the quantity of the laundry in the load by utilising the number of openings of the water intake valve and the mean of the pressure value where the measured pressure signal is stabilised. Also, the washing machine may be such that the electronic control means determines the type of the laundry in the load by utilising the timing of the openings and closings of the water intake valve and the water release properties of the laundry in the load.

Embodiments of the invention will now be described solely by way of example and with reference to the accompanying drawings in which.

Figure 1:
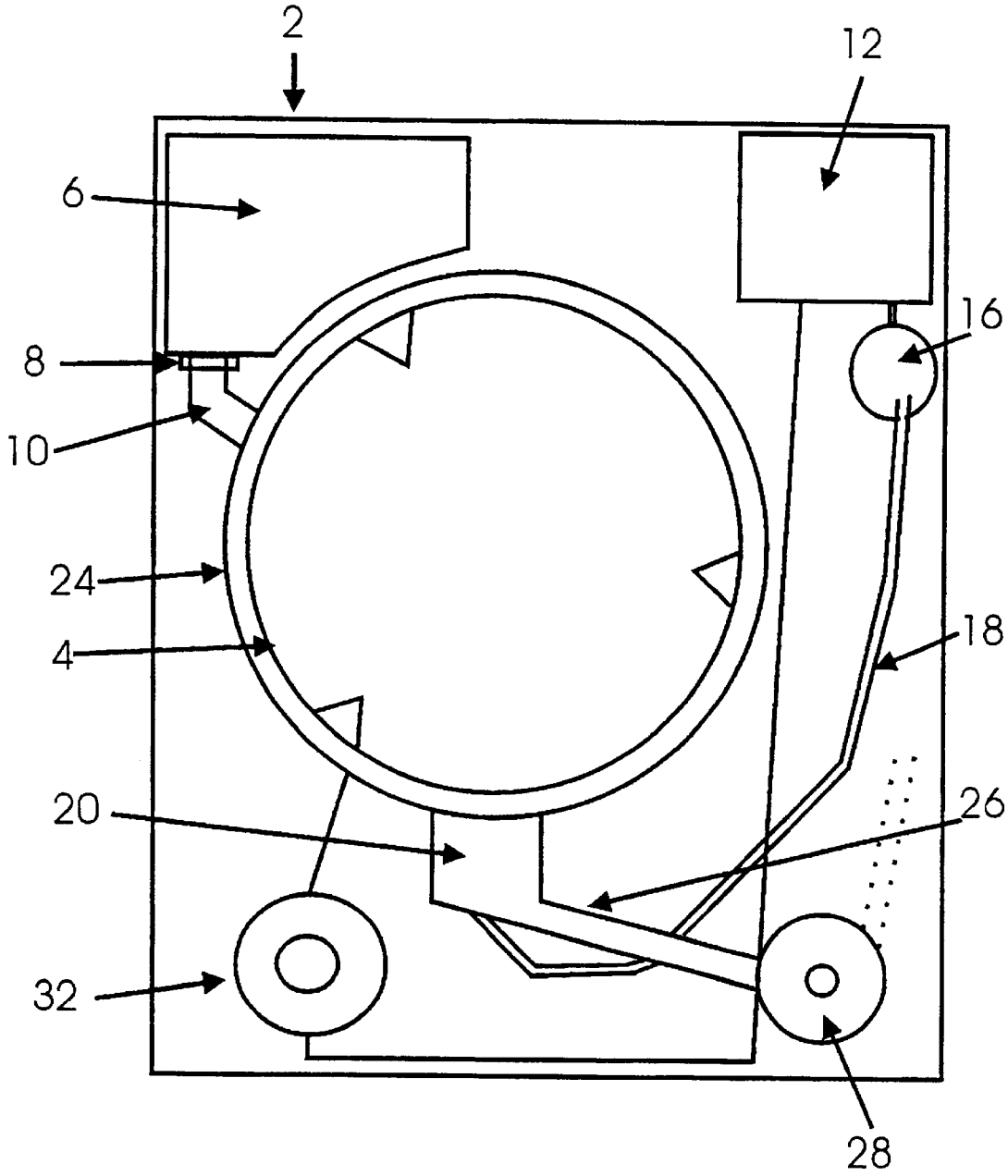
FIG. 1 shows a washing machine.

Referring to FIG. 1, there is shown a washing machine in the form of domestic washing machine 2. The washing machine 2 comprises a drum 4 for receiving a load of laundry to be washed. The washing machine 2 also comprises a detergent chamber 6 for receiving detergent to be used in the washing of the laundry. The washing machine 2 has a water intake valve 8 for allowing a water intake into the washing machine via a water intake hose 10.

Electronic control means 12 provides washing programs for the washing machine 2 and detects the quantity and type of the laundry in the load.

A pressure sensor 16 measures the pressure level in the tub 24. The pressure sensor 16 is connected to a sump 20 through a pressure sensor pipe 18.

The washing machine 2 is such that the drum 4 is housed in a tub 24. The water intake hose 10 extends between the detergent chamber 6 and the tub 24 as shown. The sump 20 leads via a conduit 26 to a liquor pump 28.

Figure 2:
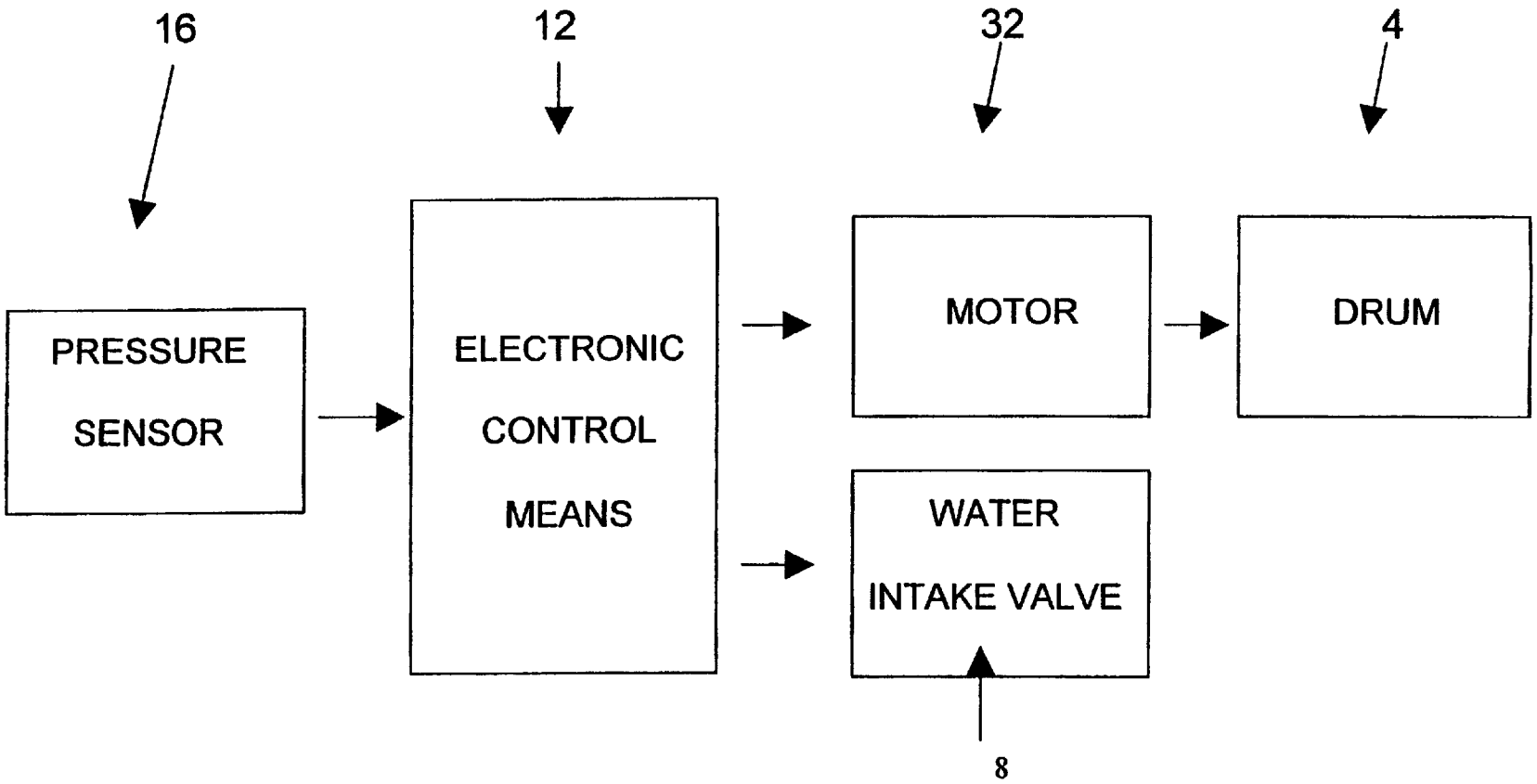
FIG. 2 is a block diagram of the major component parts of the washing machine as shown in FIG. 1.

As can best be seen from FIG. 2, the pressure sensor 16 connects to the electronic control means 12. The electronic control means 12 controls the water intake valve 8 and a motor 32. The motor 32 drives the drum 4.

During operation of the washing machine 2, the pressure sensor 16 measures the water level in the drum 4. The pressure sensor 16 sends the measured pressure value to the electronic control means 12. The electronic control means 12 opens and closes the water intake valve 8 as appropriate. The electronic control means 12 records the time interval between the openings and closings of the water intake valve. The electronic control means 12 also counts the number of openings and closings of the water intake valve 8. The electronic control means 12 further controls the duration of agitation of the drum 4, by sending appropriate control signals to the motor 32.

The electronic control means 12 determines the quantity of the laundry in the load by counting the number of openings of the water intake valve at six different first decision levels. The six different first decision levels are an almost empty level, a very low volume level, a low volume level, a medium volume level, a high volume level, and a very high volume level. If the laundry is standard cotton which is flat woven, then the almost empty level may be 0 Kg<weight of the laundry≦0.5 Kg, the very low volume level may be 0.5 Kg<weight of the laundry≦1.5 Kg, the low volume level may be 1.5 Kg<weight of the laundry≦2.5 Kg, the medium volume level may be 2.5 Kg<weight of the laundry≦3.5 Kg, the high volume level may be 3.5 Kg<weight of the laundry≦4.5 Kg, and the very high volume level may be 4.5 Kg<weight of the laundry≦5 Kg.

The electronic control means 12 determines the type of the laundry in the load by utilising the timing of the openings and closings of the water intake valve and the water release properties of the laundry in the load at three different second decision levels. These three different second decision levels are for the laundry being such that it has high water absorption and respective water release properties (typically laundry in the form of cotton terry towels and knitted wool), for the laundry being such that it has medium water absorption and respective water release properties (typically for the laundry being standard cotton), and for the laundry being such that it has low water absorption and respective water release properties (typically for the laundry being synthetic fabrics and jeans).

Figure 3:
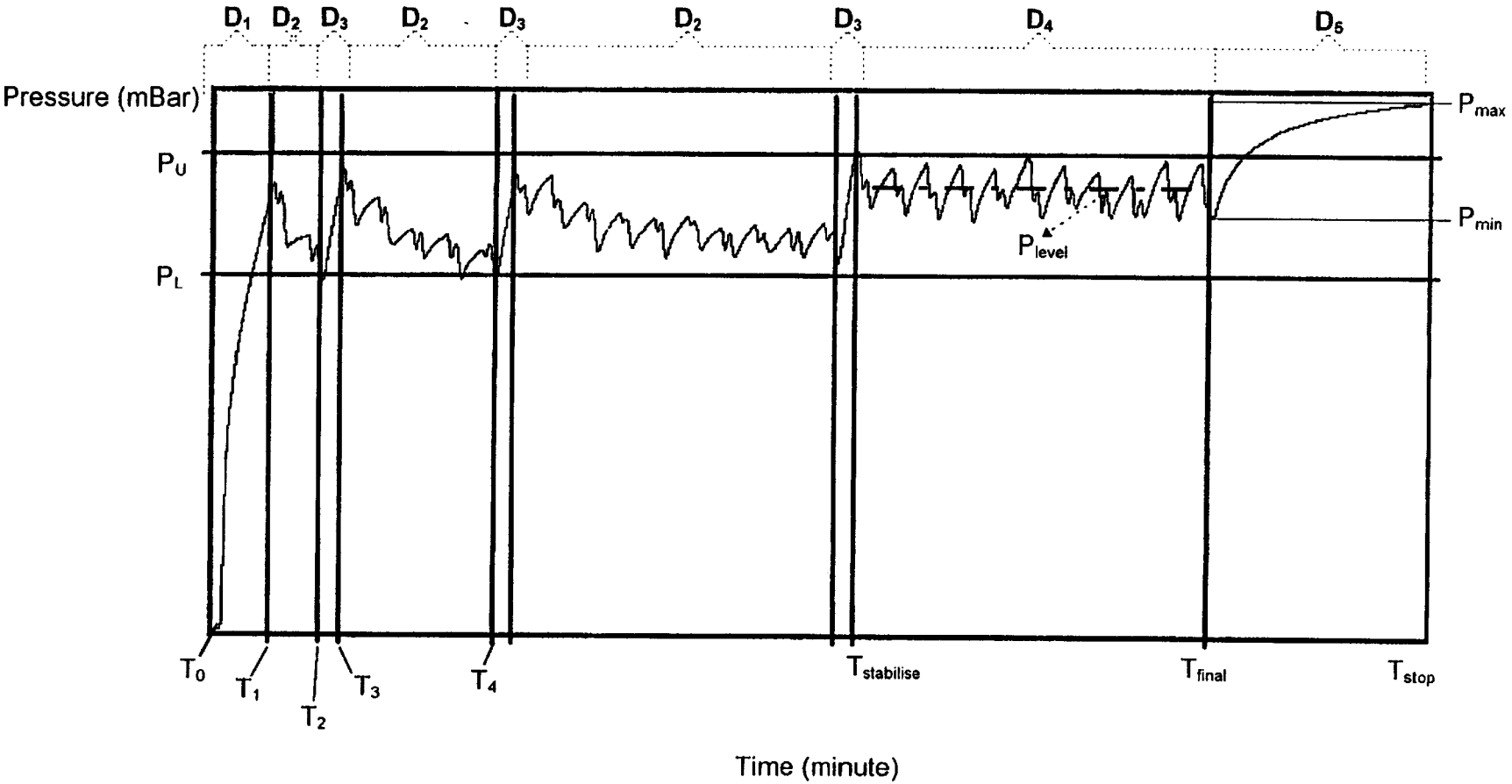
FIG. 3 shows a diagram relating to the first method of operation of the washing machine shown in FIG. 1.

In a first method of operation of the washing machine 2 as shown in FIG. 3, the electronic control means 12 controls the water intake by the following steps:

(i) opening the water intake valve 8 until a predetermined upper threshold pressure value which is measured by the pressure sensor 16 is reached;

(ii) closing the water intake valve 8, commencing agitation, and allowing the laundry to absorb water until a predetermined lower threshold pressure value is reached;

(iii) repeating steps (i) and (ii) until the laundry is completely wet, and the measured pressure stabilises at a level; and (iv) providing a period during which there is no agitation of the laundry and no intake of the water, whereby the laundry releases water and causes a pressure increase, and the pressure sensor 16 measures the pressure increase to obtain information about the type of laundry.

The above first method of operation is illustrated in FIG. 3. The explanation of FIG. 3 is as follows.

$D_1$. The period of first water intake until the upper threshold $P_u$ is reached.

$D_2$. The interval where agitation is allowed, and where the laundry absorbs water until the lower threshold $P_L$ is reached.

$D_3$. The interval where the water intake occurs, and where the laundry absorbs water.

$D_4$. The interval where the laundry is completely wet and the pressure is stabilised at $P_{level}$.

$D_5$. The interval where the agitation and the water intake are not allowed.

Some of the water absorbed by the laundry is released.

$T_0$: The time when the first opening of the water intake valve 8 occurs.

$T_1$: The time when the first closing of the water intake valve 8 occurs.

$T_2$: The time when the second opening of the water intake valve 8 occurs.

$T_3$: The time when the second closing of the water intake valve 8 occurs.

$T_4$: The time when the third opening of the water intake valve 8 occurs.

$T_{stabilise}$: The time when the last closing of the valve occurs.

$T_{final}$: The time when agitation and water intake are stopped and water release starts.

$T_{stop}$: The time when the measurement finishes.

$P_{max}$: The pressure level at $T_{stop}$.

$P_{min}$: The pressure level at time $T_{final}$.

$P_{level}$: The pressure level at which the stabilization occurs.

$P_U$: Predetermined upper threshold pressure value.

$P_L$: Predetermined lower threshold pressure value.

The detection of the quantity of the laundry in the load for a given certain $P_U$ and $P_L$ by the electronic control means 12 utilising the above first method of the invention may be expressed as follows:

1. If "the number of openings" is equal to (n=1) until time $T_{stabilise}$ and the pressure level is $P_{level}$ during the time interval ($T_{final}-T_{stabilise}$), the quantity of the laundry in the load inside the washing machine 2 is almost nil.
2. If "the number of openings" is ($1<n\leqq 2$) until time $T_{stabilise}$ and the pressure level is $P_{level}$ during the time interval ($T_{final}-T_{stabilise}$), the quantity of the laundry in the load inside the washing machine 2 is very low.
3. If "the number of openings" is ($2<n\leqq 3$) until time $T_{stabilise}$ and the pressure level is $P_{level}$ during the time interval ($T_{final}-T_{stabilise}$), the quantity of the laundry in the load inside the washing machine 2 is low.
4. If "the number of openings" is ($3<n\leqq 4$) until time $T_{stabilise}$ and the pressure level is $P_{level}$ during the time interval ($T_{final}-T_{stabilise}$), the quantity of the laundry in the load inside the washing machine 2 is medium.
5. If "the number of openings" is ($4<n\leqq 5$) until time $T_{stabilise}$ and the pressure level is $P_{level}$ during the time interval ($T_{final}-T_{stabilise}$), the quantity of the laundry in the load inside the washing machine 2 is high.
6. If "the number of openings" is ($n>5$) until time $T_{stabilise}$ and the pressure level is $P_{level}$ during the time interval ($T_{final}-T_{stabilise}$), the quantity of the laundry in the load inside the washing machine 2 is very high.

It is to be noted that the values of "n" given above are valid for a given certain $P_U$ and $P_L$ but might be another value if $P_U$ and $P_L$ are changed.

In a second method of operation of the washing machine 2, the electronic control means 12 controls the water intake by the following steps:

(i) opening the water intake valve 8 until a predetermined upper threshold pressure value which is measured by the pressure sensor 16 is reached;

(ii) closing the water intake valve 8, commencing agitation, and allowing the laundry to absorb water until a predetermined lower threshold pressure value is reached;

(iii) repeating steps (i) and (ii) for a predetermined duration unless the lower threshold pressure value is reached;

(iv) closing the water intake valve 8, commencing agitation, and maintaining the agitation for a predetermined period even if the pressure level drops below the predetermined minimum lower threshold value;

(v) at the end of the predetermined period in step (iv) opening the water intake valve 8 if the pressure level in step (iv) has dropped below the predetermined minimum lower threshold value;

(vi) repeating steps (iv) and (v) until the laundry is completely soaked as indicated by a stabilisation of the pressure;

(vii) checking after a predetermined time that the pressure is still stable and if the pressure has dropped repeating step (v) one more time; and (viii) providing a period during which there is no agitation and no intake of the water, whereby the laundry releases water and causes a pressure increase, and the pressure sensor 16 measures the pressure increase to obtain information about the type of the laundry.

Figure 4:
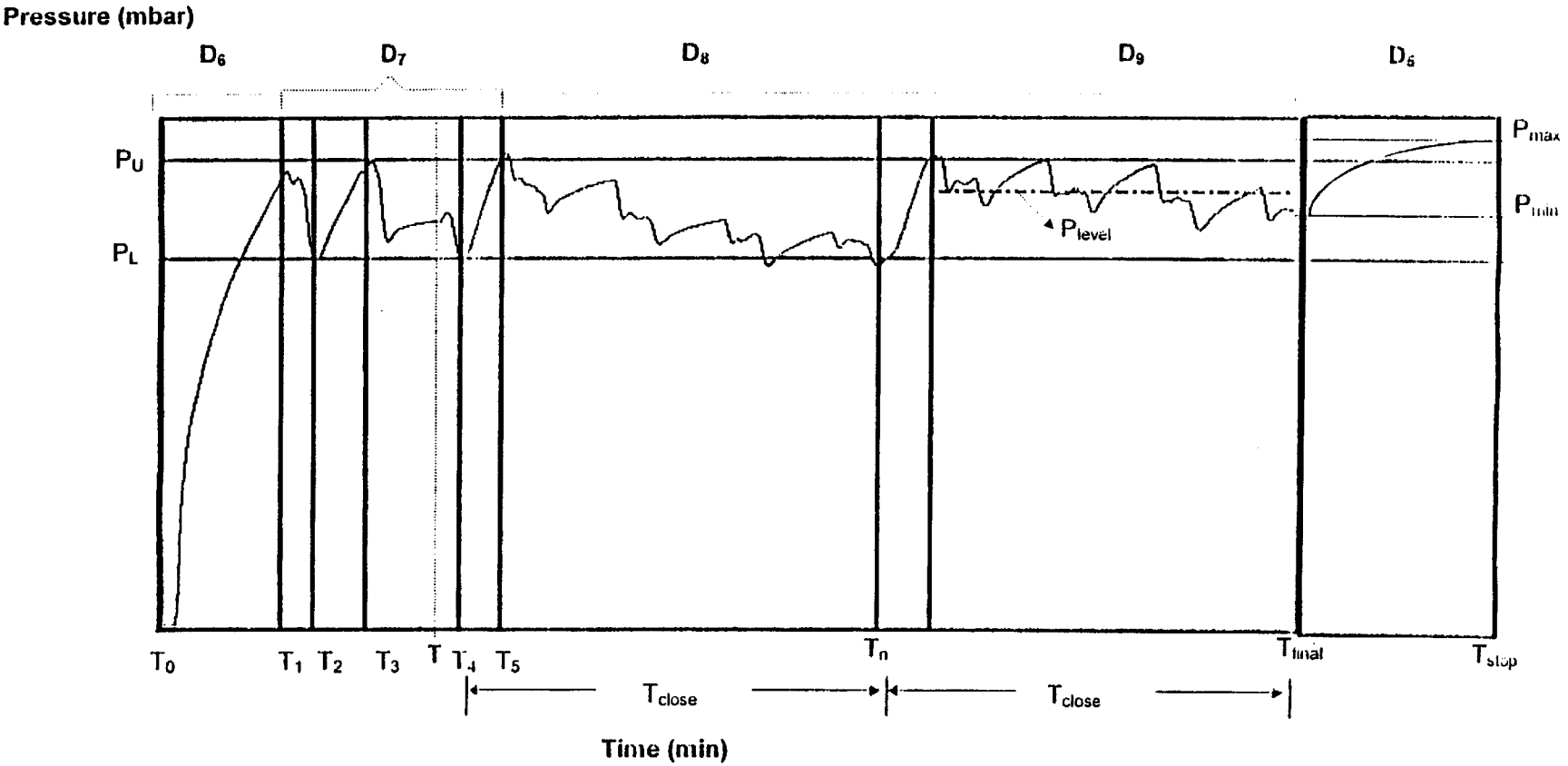
FIG. 4 shows a diagram relating to the second method of operation of the washing machine shown in FIG. 1.

The method of operation of the washing machine 2 in the above mentioned second mode is illustrated in FIG. 4. The explanation of FIG. 4 is as follows.

$D_5$. The interval where the agitation and the water intake are not allowed. Some of the water absorbed by the laundry is released.

$D_6$. First water intake until the upper threshold $P_u$ is reached.

$D_7$. The interval where the control of agitation and water intake is the same as FIG. 3.

$D_8$. The interval where the agitation and water absorption start. Water intake is not allowed for $T_{close}$ minutes even if the pressure level is below $P_L$.

$D_9$. The interval where the laundry is completely wet and the pressure level is stabilised at $P_{level}$.

$T_0$: The time when the first opening of the water intake valve 8 occurs.

$T_1$: The time when the first closing of the water intake valve 8 occurs.

$T_2$: The time when the second opening of the water intake valve 8 occurs.

$T_3$: The time when the second closing of the water intake valve 8 occurs.

$T_4$: The time when the third opening of the water intake valve 8 occurs.

$T_5$: The time when the third closing of the water intake valve 8 occurs.

T: Predetermined duration during which water intake and agitation occurs.

$T_n$: The time when the $n^{th}$ opening of the water intake valve 8 occurs.

$T_{final}$: The time when agitation and water intake are stopped and water release starts.

$T_{stop}$: The time when the measurement finishes.

$T_{close}$: Predetermined duration during which agitation continues even if the pressure level drops below the $P_L$ $P_{max}$: The pressure level at time $T_{stop}$.

$P_{min}$: The pressure level at time $T_{final}$.

$P_U$: Predetermined upper threshold pressure value.

$P_L$: Predetermined lower threshold pressure value.

$P_{level}$: The pressure level at which the stabilization occurs.

n: number of openings of the water intake valve 8.

The detection of the quantity of the laundry in the load for a given certain $P_U$ and $P_L$ by the electronic control means 12 utilising by the above second method of the invention may be expressed as follows.

1. If "number of openings" of the water intake valve 8 is (n=1) and, time t=T and the pressure level is $P_{level}$, or time $t=T_n+T_{close}>T$ and the pressure level is $P_{level}$, during the interval $T_n$ to $T_n+T_{close}$, the laundry is completely wet and the quantity of the laundry in the load inside the washing machine 2 is almost nil.
2. If "the number of openings" of the water intake valve 8 is ($1<n\leqq 2$) and, time t=T and the pressure level is $P_{level}$, or time $t=T_n+T_{close}>T$ and the pressure level is $P_{level}$ during the interval $T_n$ to $T_n+T_{close}$, the laundry is completely wet and the quantity of the laundry in the load inside the washing machine 2 is very low.
3. If "the number of openings" of the water intake valve 8 is ($2<n\leqq 3$) and, time t=T and the pressure level is $P_{level}$, or time $t=T_n+T_{close}>T$ and the pressure level is $P_{level}$ during the interval $T_n$ to $T_n+T_{close}$, the laundry is completely wet and the quantity of the laundry in the load inside the washing machine 2 is low.
4. If "the number of openings" of the water intake valve 8 is ($3<n\leqq 4$) and, time t=T and the pressure level is $P_{level}$, or time $t=T_n+T_{close}>T$ and the pressure level is $P_{level}$ during the interval $T_n$ to $T_n+T_{close}$, the laundry is completely wet and the quantity of the laundry in the load inside the washing machine 2 is medium.
5. If "the number of openings" of the water intake valve 8 is ($4<n\leqq 5$) and, time t=T and the pressure level is $P_{level}$, or time $t=T_n+T_{close}>T$ and the pressure level is $P_{level}$ during the interval $T_n$ to $T_n+T_{close}$, the laundry is completely wet and the quantity of the laundry in the load inside the washing machine 2 is high.
6. If "the number of openings" of the water intake valve 8 is (n>5 and, time t=T and the pressure level is $P_{level}$, or time $t=T_n+T_{close}>T$ and the pressure level is $P_{level}$, during the interval $T_n$ to $T_n+T_{close}$, the laundry is completely wet and the quantity of the laundry in the load inside the washing machine 2 is very high.

It is to be noted that the values of "n" given above are valid for a given certain $P_U$ and $P_L$ but might be another value if $P_U$ and $P_L$ are changed.

The advantage of the second method of operation is that it has a significantly shorter detection time than in the first method of operation.

The two methods of washing as described above with reference to FIGS. 3 and 4 are both such that the laundry in the washing machine 2 absorbs water, and the pressure measured by the pressure sensor 16 decreases until the laundry is completely wet. Therefore, at an optimum of pressure settings ($P_U$ and $P_L$ ) for opening and closing of the water intake valve 8, and optimised setting of agitation, the number of openings of the water intake valve 8 is directly proportional to the quantity of the laundry introduced into the washing machine 2. Also, the timing of the openings is directly proportional to the absorption properties of the laundry introduced into the washing machine 2.

For the detection of the type of laundry in the load, the space of time is looked at between the closing of the water intake valve 8 and the opening of the water intake valve 8 for the phases following the first two water intakes ($T_2-T_1$ and $T_4-T_3$). During these spaces of time, the agitation causes the load to soak up water. The ratio $(T_4-T_3)/(T_2-T_1)$ is a means for the detection of the type of the introduced load. Furthermore, each single time value $T_1$, $T_2$, $T_3$ and $T_4$, and water release properties are also used in association with $(T_4-T_3)/(T_2-T_1)$.

The electronic control means utilizes the measured pressure values to detect the quantity and type of the laundry in the load, whilst the same signal is also used to control the water intake valve.

In the first method described above, the water absorption and release properties of the laundry in the load are used for detection purposes, and, only, upper and lower threshold values control the water intake. The number of openings of the water intake valve are detected, and this information is used to determine the quantity of the water. This information is actually a map (indirect sensing) of the amount of water taken into the washing machine 2. A disadvantage of this first method is that it requires a relatively long duration in order to detect the quantity and type of the laundry in the load.

The second method described above is similar to the first method but it overcomes the disadvantage of the first method. More specifically, the duration required to detect the volume and type is determined adaptively according to the quantity of the laundry in the load. The duration required to detect lower quantities is shorter than for higher quantities.

Figure 5:
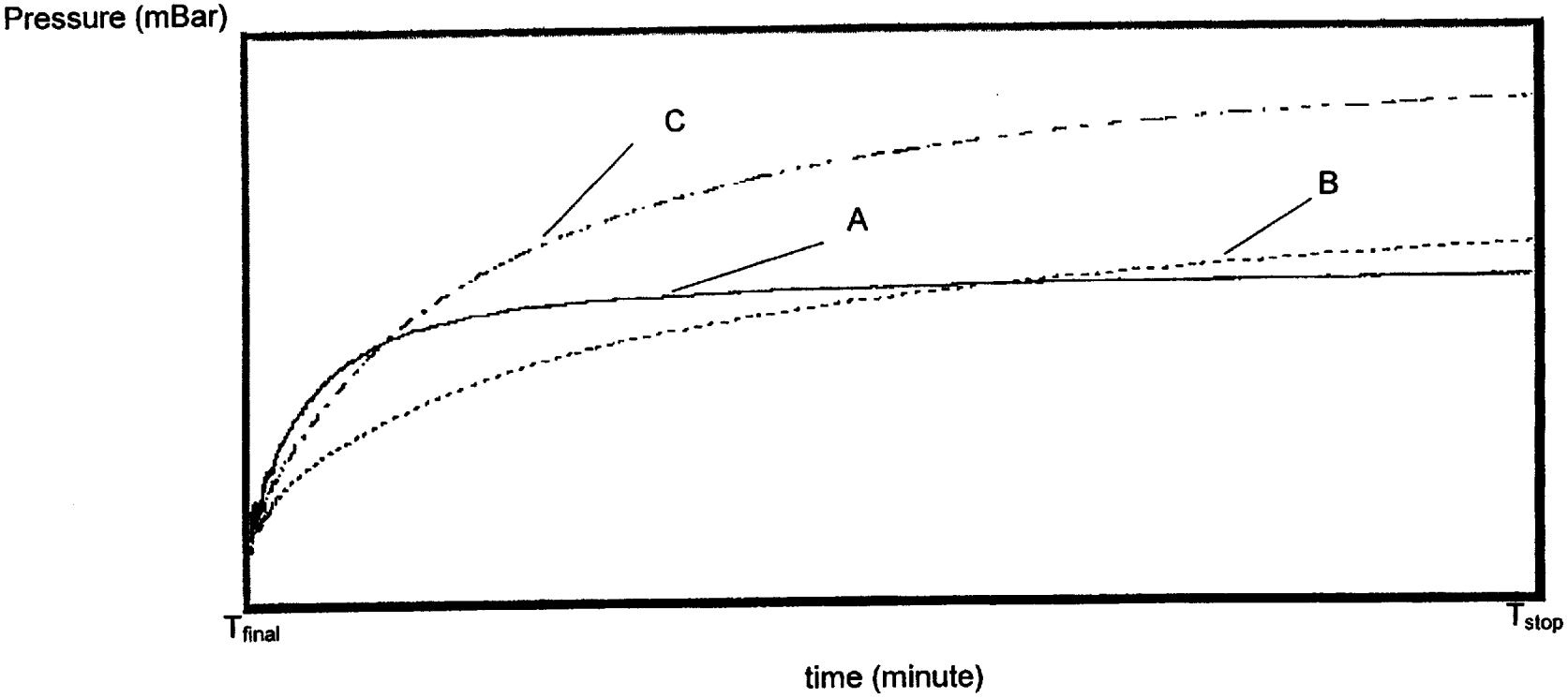
FIG. 5 is a graph showing the water release properties of three different types of fabrics.

Referring now to FIG. 5, there is shown a curve A for a fabric having low water release properties. Curve B is for a fabric having medium water release properties. Curve C is for a fabric having high water release properties. The curves A, B and C are for pressure (mBar) against time (minutes) and are exploitation of experimental results. Electronic control means 12 first, determines the quantity of the laundry in the load. Then, electronic control means 12 compares $(T_2-T_1)$, $(T_4-T_3)$, $(T_4-T_3)/(T_2-T_1)$, $T_1$, $T_2$, $T_3$ , $T_4$ and $(P_{max}-P_{min})$ with predetermined threshold values and determines the type of the laundry in the load.

It is to be appreciated that the embodiments of the invention described above with reference to the accompanying drawings have been given by way of example only and that modifications may be effected.

What is claimed is:

1. A washing machine comprising a drum for receiving a load of laundry to be washed, a detergent chamber for receiving detergent to be used in the washing of the laundry, a water intake valve for allowing a water intake into the washing machine, a pressure sensor for measuring pressure signals, and electronic control means for providing washing programs for the washing machine, and for detecting the quantity and type of the laundry in the load, characterised in that the electronic control means which acts firstly to detect the quantity of the laundry in the load through counting the number of openings of the water intake valve and which acts secondly to determine the type of laundry in the load by utilising the timing of the openings and closings of the water intake valve and the water release properties of the laundry in the load.

2. A washing machine according to claim 1 in which the control of the water intake is effected by the pressure values measured by the pressure sensor and in which the measuring of the pressure signals is in dependence upon water absorption and water release properties of the laundry in the load.

3. A washing machine according to claim 2 in which the electronic control means operates to determine the quantity of the laundry in the load by counting the number of openings of the water intake valve and a stabilised pressure value in the pressure signal measured by the pressure sensor.

4. A washing machine according to claim 3 in which the electronic control means operates to determine the type of the laundry in the load by utilising (i) the time interval between a second opening of the water intake valve and a first closing of the water intake valve, and the time interval between a third opening of the water intake valve and a second closing of the water intake valve, (ii) the time values of the first closing of the water intake valve, the second closing of the water intake valve, the second opening of the water intake valve, and the third opening of the water intake valve, and (iii) the water release properties of the laundry in the load as indicated by pressure changes measured by the pressure sensor.

5. A washing machine according to claim 1 in which the electronic control unit determines the quantity of the laundry in the load by measuring the pressure signals at a plurality of different first decision levels.

6. A washing machine according to claim 5 in which there are six of the different first decision levels.

7. A washing machine according to claim 6 in which the six different first decision levels are an almost empty level, a very low volume level, a low volume level, a medium volume level, a high volume level, and a very high volume level.

8. A washing machine according to claim 1 in which the electronic control means determines the type of the laundry in the load by measuring the pressure signals at a plurality of different second decision levels.

9. A washing machine according to claim 8 in which there are three of the different second decision levels.

10. A washing machine according to claim 9 in which the three different second decision levels are for the laundry being such that it has high water absorption and respective water release properties, for the laundry being such that it has medium water absorption and respective water release properties, and for the laundry being such that it has low water absorption and respective water release properties.

11. A washing machine according to claim 1 in which electronic control means controls the water intake by the following steps:

(i) opening the water intake valve until a predetermined upper threshold pressure value which is measured by the pressure sensor is reached;

(ii) closing the water intake valve, commencing agitation, and allowing the laundry to absorb water until a predetermined lower threshold pressure value is reached;

(iii) repeating steps (i) and (ii) until the laundry is completely wet, and the measured pressure stabilises is at a level; and (iv) providing a period during which there is no agitation of the laundry and no intake of the water, whereby the laundry releases water and causes a pressure increase, and the pressure sensor measures the pressure increase to obtain information about the type of the laundry in the load.

12. A washing machine according to claim 1 in which the electronic control means controls the water intake by the following steps:

(i) opening the water intake valve until a predetermined upper threshold pressure value which is measured by the pressure sensor is reached;

(ii) closing the water intake valve, commencing agitation, and allowing the laundry to absorb water until a predetermined lower threshold pressure value is reached;

(iii), repeating steps (i) and (ii) for a predetermined duration unless the lower threshold pressure value is reached;

(iv) closing the water intake valve, commencing agitation, and maintaining the agitation for a predetermined period even if the pressure level drops below the predetermined minimum lower threshold value;

(v) at the end of the predetermined period in step (iv) opening the water intake valve if the pressure level in step (iv) has dropped below the predetermined minimum lower threshold value;

(vi) repeating steps (iv) and (v) until the laundry is completely soaked as indicated by a stabilisation of the pressure;

(vii) checking after a predetermined time that the pressure is still stable and if the pressure has dropped repeating step (v) one more time; and (viii) providing a period during which there is no agitation and no intake of the water, whereby the laundry releases water and causes a pressure increase, and the pressure sensor measures the pressure increase to obtain information about the type of the laundry in the load.

* * * * *